US005456563A

United States Patent [19]

Halbo

[11] Patent Number: 5,456,563

[45] Date of Patent: Oct. 10, 1995

[54] PACKING MACHINE

[75] Inventor: Hansjorg Halbo, Neutraubling, Germany

[73] Assignee: Krones AG, Neutraubling, Germany

[21] Appl. No.: 166,527

[22] Filed: Dec. 14, 1993

[30] Foreign Application Priority Data

Dec. 19, 1992 [DE] Germany ..... 42 43 010.0

[51] Int. Cl.[6] ..... B65B 21/02; B65G 65/02

[52] U.S. Cl. ..... 414/416; 198/432; 198/470.1; 53/250

[58] Field of Search ..... 414/416, 417, 414/225; 53/247, 250, 48.6; 198/432, 469.1, 470.1

[56] References Cited

U.S. PATENT DOCUMENTS

| | | | |
|---|---|---|---|
| 2,611,493 | 9/1952 | Nordquist . | |
| 2,966,995 | 1/1961 | Steinle | 414/416 |
| 3,185,328 | 5/1965 | Dardaine et al. | 414/416 |
| 4,257,727 | 3/1981 | Peyton | 414/416 |
| 4,793,762 | 12/1988 | Munch et al. | 414/416 |
| 5,257,888 | 11/1993 | Kronseder | 414/416 |

FOREIGN PATENT DOCUMENTS

| | | |
|---|---|---|
| 1148486 | 11/1963 | Germany . |
| 2460957 | 6/1976 | Germany . |
| 3336766 | 8/1985 | Germany . |
| 3826785 | 7/1989 | Germany . |
| 4125573A1 | 5/1992 | Germany . |

*Primary Examiner*—Michael S. Huppert
*Assistant Examiner*—Stephen Gordon
*Attorney, Agent, or Firm*—Ryan, Maki & Hohenfeldt

[57] ABSTRACT

Empty bottle cases that are to have filled and capped bottles inserted in them and cases filled with returned bottles are simultaneously fed to the machine on individual conveyor belts. Filled and capped bottles are fed to the machine on another individual conveyor belt and still another conveyor belt conducts the empty returned bottles away. A plurality of bottle handling heads on which there are bottle grippers are driven along a predetermined path for gripping bottles in a sequence that involves removing returned contaminated bottles from cases on one conveyor belt and transferring the bottles to another conveyor belt for discharge from the machine while at the same time, capped bottles come in on a conveyor belt and are picked up by a head and transferred to another conveyor belt where they are inserted into the empty cases that are moving on a conveyor belt.

10 Claims, 4 Drawing Sheets

PACKING MACHINE

BACKGROUND OF THE INVENTION

The invention disclosed herein pertains to a machine for packing and unpacking articles such as cans and bottles to and from cases or other containers.

Packing machines are now known which have continuous uninterrupted operating cycles rather that intermittent cycles. Existing machines are dedicated to either packing or unpacking cases or other containers. This means, for example, that in a bottle filling line two machines are required, one for unpacking empty bottles returned by consumers and another machine for packing cases with newly filled bottles. Separate machines for packing and unpacking cases require a substantial amount of space in a building along with the appropriate conveyors that they require to perform packing and unpacking operations. The limitation applies to existing packing machines such as are offered by various manufacturers and are described, for example, in U.S. Pat. No. 4,793,762 and German patent application, DE-OS 41 25 573.

So-called double track packing machines are known as illustrated in German laid open application DE-OS 33 36 766. Combination packing and unpacking machines were proposed in German laid open application DE-OS 24 60 957. It is difficult to employ preexisting high performance machines in continuously operating production lines because empty bottles, filled bottles and cases for the bottles are fed intermittently.

SUMMARY OF THE INVENTION

An objective of the present invention is to 10 provide a packing machine that can unpack articles such as bottles from cases or other containers and also pack bottles into containers or cases with a machine that requires less space than two individual dedicated machines while operating at a high performance rate.

The objective is achieved, in accordance with the invention, by feeding empty cases or other containers on one conveyor and concurrently feeding containers containing articles of a first type, such as empty bottles, on an adjacent conveyor where the empty containers and containers filled with empty bottles are advanced in phase with each other. The empty containers, hereafter called cases for the sake of brevity, are advanced to an operating station wherein orbiting packing heads that are carrying articles of a second type, such as filled bottles, obtained from a parallel running conveyor, inserts them in one of the cases while simultaneously gripping and picking up the group of empty bottles from a case on an adjacent conveyor for removing the empty bottles. The empty group of bottles are then carried further orbitally whereupon the group of empty bottles, in the condition in which they are returned from customers, are deposited on a moving conveyor which is running parallel with another conveyor, while the second or other conveyor is transporting groups of articles of a second type such as filled bottles. When the orbiting head reaches a predetermined position over the second pair of parallel conveyors, the empty bottles are transferred to one of the conveyors and a group of filled bottles is picked up simultaneously. The head then advances with a group of filled bottles to deposit them in the empty cases 10 which were being transported along one of the conveyors in the first pair. The removal of empty bottles from cases on one of the conveyors in the first pair of conveyors, insertion of filled bottles in cases in another of the conveyors in the first pair, transfer of the bottles to a conveyor in the second pair and picking up a group of filled and capped bottles from the other conveyor in the second pair and transferring the group to the empty cases on the one conveyor in the first pair are performed in a completely continuous operating cycle.

In the one embodiment of the invention just outlined, the conveyor belts in the first pair of conveyors run parallel and adjacent each other although they are at slightly different levels. The conveyor belts in the other pair also run parallel to each other and are at slightly different levels.

In a second embodiment, the pair of conveyors that convey empty cases along with cases filled with empty and returnable bottles are superimposed over each other and the conveyors in the other pair which are used for bringing in filled bottles and for carrying away empty used bottles are superimposed over each other.

The bottle handling heads of the machine are provided with the grippers that are controllable for effecting a grip on a group of bottles at an appropriate time and for releasing the grip at another time so that groups of bottles can be picked up from one conveyor and let down on another conveyor as required. The machines are symmetrical in the sense that with an even number of article or bottle containing heads, one-half of them operate as unpackers and the other half as packers with the system employing a plurality of conveyors, product throughput is enhanced.

How the foregoing and other more specific objects and features of the invention are achieved and implemented will be evident in the ensuing more detailed description of illustrative embodiments of the invention which will now be set forth in reference to the drawings.

DESCRIPTION OF A PREFERRED EMBODIMENT

Figure 1:
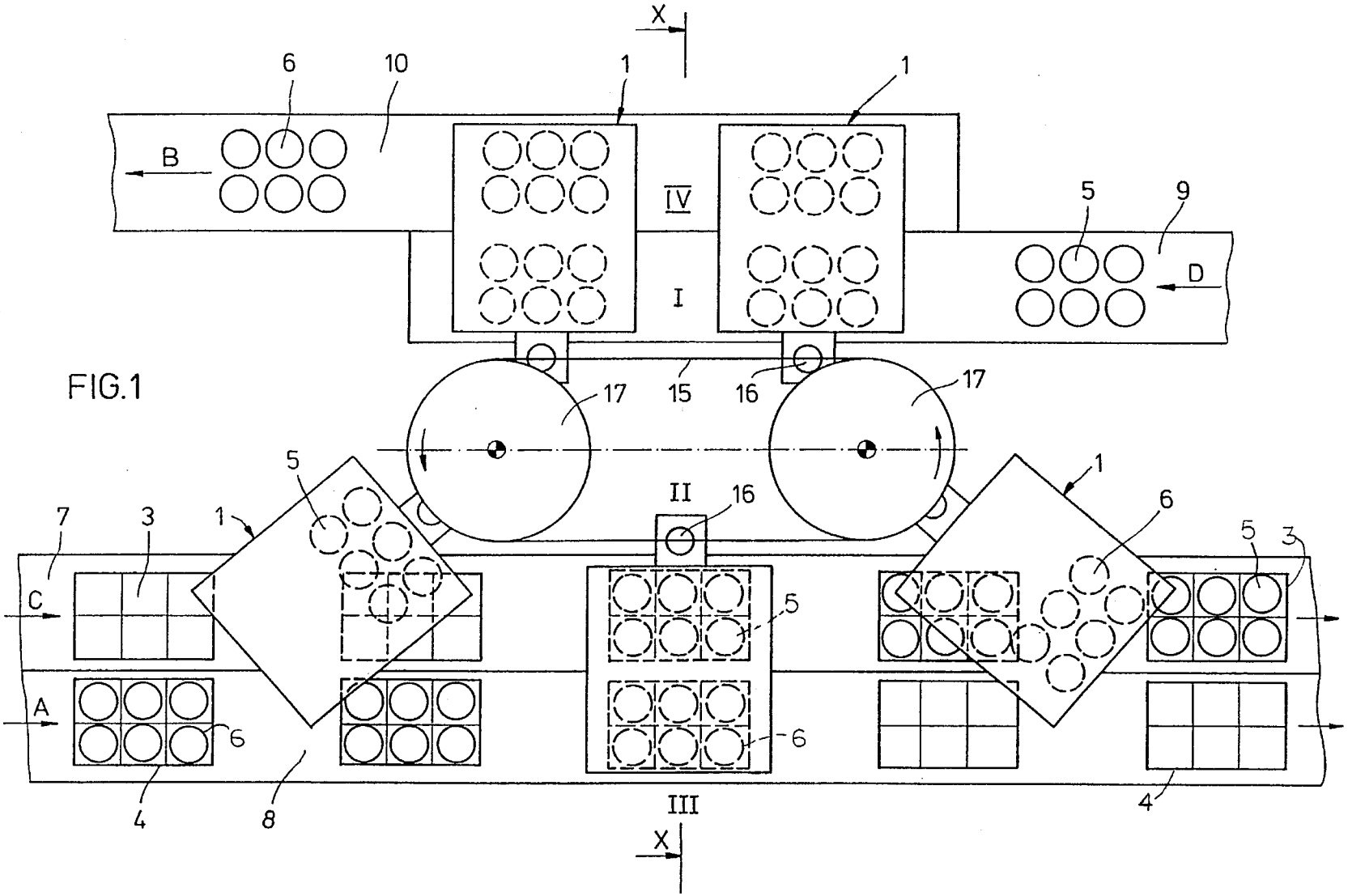
FIG. 1 is a mostly diagrammatic top plan view of a bottle packing and unpacking machine embodying and implementing the inventive concept.

Referring to FIG. 1, the new article packing and unpacking machine comprises five article handling heads marked 1. The articles used for demonstrating the invention are bottles. The heads are shown in various positions in their operating sequence. All of the heads perform the same multiple functions. An upper set of power driven wheels 17 on which a flexible closed loop element 15 runs constitute the drive for carrying the heads 1. Wheels 17 rotate about vertical axis of a rotationally driven column 18. The wheels 17 could simply have a peripheral groove in which the flexible closed loop element runs. The flexible element can be a chain or cable, for example. In the illustrated embodiment, the wheels 17 are sprockets, and the flexible closed loop element is a chain 15. As illustrated diagrammatically in 10 FIG. 1, the bottle handling heads 1 are all connected to chain 15 at equally spaced intervals. As is evident in FIG. 2, there are two sets of sprockets 17 and chains 15 where one is above the other, and the sprockets are mounted to shafts or columns 18 which are motor driven rotationally. The closed loop chain defines an oblong path along which the heads translate groups of articles such as bottles. The motor drive is omitted, since it is only necessary to appreciate that a column 18 is driven rotationally.

Figure 2:
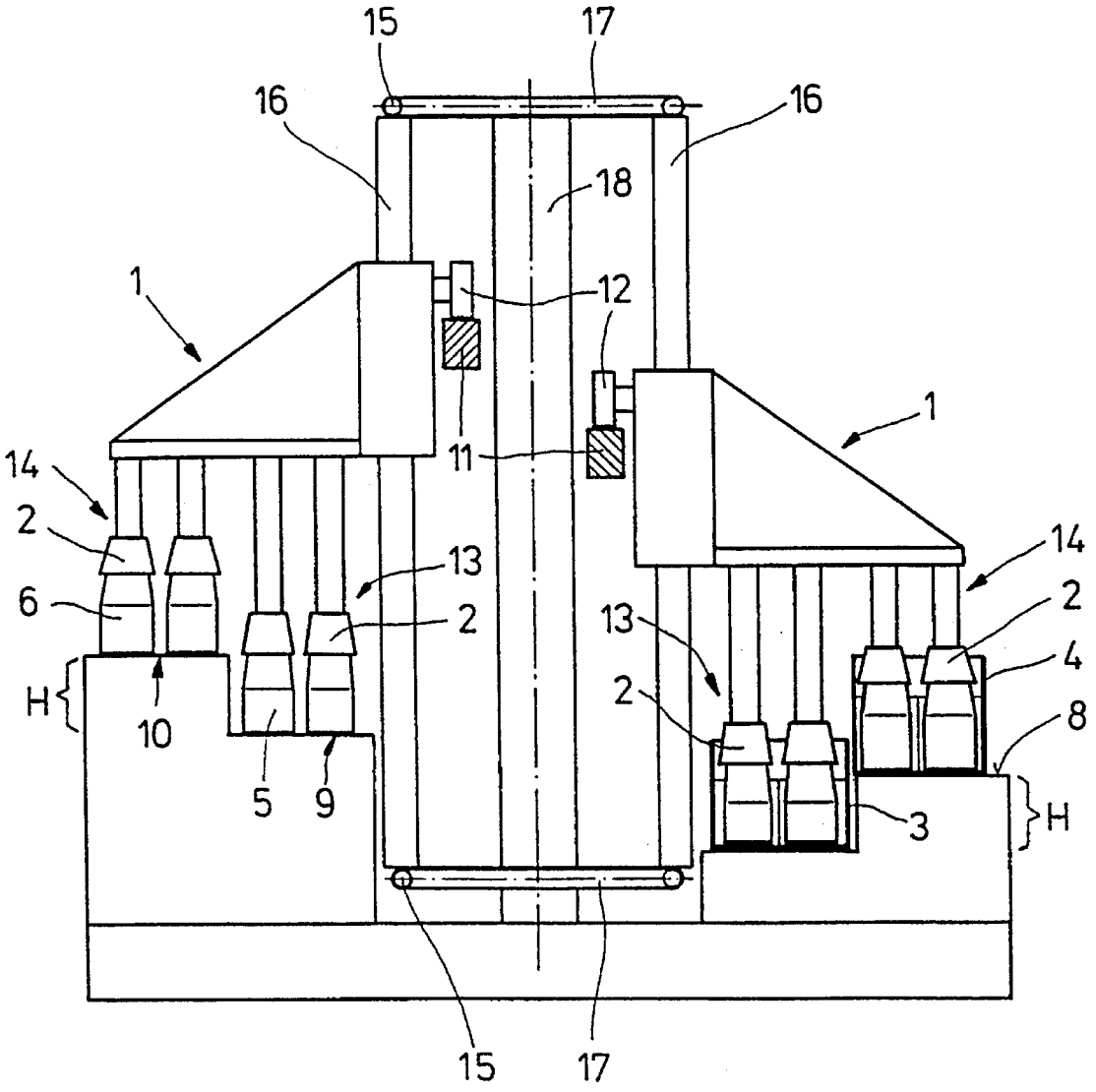
FIG. 2 is a vertical section taken on a line corresponding with 2—2 in FIG. 1.

As is evident in FIG. 2, heads 1 can be raised and lowered on guide rods 16. The packing heads 1 are secured against rotating on the guide rods by means which are not shown. Each packing head 1 runs adjacent a stationary cam 11. The bottle handling heads 1 have cam follower rollers 12 which cooperate with the cams 11 to raise and lower bottle handling heads 1 at appropriate times. The vertical guide rods 16 are attached at opposite ends to chains 15.

As shown in FIG. 2, each bottle handling head 1 carries a first group 13 of gripper elements 2 and a second group 14 of gripper elements 2 which are controlled independently of each other. The gripper element groups are operable to selectively grip a group of bottles and transfer the group to another location where the bottles are released for being inserted in a container such as bottle case or for simply being transported to a destination where the bottles will be cleaned or have some other function performed on them. FIGS. 1 and 2 illustrate a configuration where the first group of gripper elements 2, operating at in an inboard track or conveyor, function as packers and the second 10 group 14 of gripper elements 2 operate on the outboard track as unpackers. In the right region of FIG. 2, one may see that containers constituting bottle cases 3 and 4 are being transported onto adjacent conveyor belts 7 and 8 which are at different levels but are parallel to each other. In FIG. 1, the cases 4 on conveyor 7 are presently filled with a group of customer returned empty bottles 6 which, in the particular embodiment shown, each group is comprised of six bottles and is in the nature of a so-called six-pack. Conveyor belt 8, adjacent conveyor belt 7 in FIG. 1, is conveying empty containers, that is, empty cases in phase with the cases that are filled with empty bottles on conveyor 7. Also, in the left region of FIG. 2, one may see that there is another set of conveyor belts 9 and 10 on which uncased bottles 6 are presently standing while being gripped by a corresponding number of grippers 2. The conveyors 9 and 10 can be designated tracks and the same is true of conveyors 7 and 8. As shown in FIG. 1, conveyor belt 10 receives empty returned bottle groups 6 which were transferred by heads 1 from conveyor belt 8. Groups 6 are released from grippers 2 at transfer station IV and are conveyed away in the direction of arrow B or conveyor belt 10. Articles of the second type, namely filled and crowned bottle groups 5 come in on belt 9 and are gripped at transfer station I after which they are carried by a head 1 and deposited in any empty case 3 on belt 7. It will be noted that the conveyors on both sides of the machine run at different elevations which will be appreciated subsequently when a complete operating cycle of the machine is described.

It is advantageous to have the pairs of conveyors 7,8 on one side of the rotational path of the bottle handling head path and on the opposite side having the other parallel conveyors 9 and 10. Conveyors 7 and 8 can be designated as container conveyors and conveyors 9 and 10 can be designated as product conveyors. The container case conveyor 7, 8 and the product filled bottle conveyors 9,10 can each have a common conveyor plane positioned below each other. Note that the conveyor belt pairs 9 and 10 on the left side of the conveyor in FIG. 2 are offset vertically relative to each other by the distance H. Similarly, the conveyor belts 7 and 8 on the right side of the machine in FIG. 2 are offset by a similar vertical distance H. Thus, inboard conveyor belt 9 on the left side of the machine is a predetermined vertical distance above inboard conveyor belt 7 on the right side of the machine. Similarly, outboard conveyor 10 on the left side of the machine is at the same elevation above outboard conveyor belt 8 on the right side of the machine as inboard conveyor belt 9 is above inboard conveyor 7. If the offset in height H corresponds with the height of the articles or bottles 5 which are transported on the inner product conveyor 9, an additional raising of the packing head is not necessary to avoid collisions at the crossover point of the rotational path of travel of the outer second group 14 of the gripper elements 2 with the inner product conveyor 9. If, as in FIGURE 2, both container conveyors 7,8 are located below the plane of conveyance of each of the product conveyors 9 and 10 and are at least lower in height than the height of containers 3 and 4, the lift of the heads 1 required to set in and take out the bottle containing cases 3 and 4 that must be executed by the bottle head 1 while at the side of the product conveyors 9 and 10 is only very slight. A slight lift of a head 1 during its total rotational travel causes a very slight burden on the machine and products and allows for a compact short machine.

Now to be described is the manner in which the packing and unpacking machine operates to remove a group of articles of a first type such as possibly contaminated returned bottles from containers such as cases, fill empty containers such as cases with articles of a second type such as filled and capped bottles, transfer cases from which the returned bottles have been removed so that the empty cases can be conveyed to a place where they are conveyed away for being washed, inspected, refilled and capped will now be described in greater detail in reference to FIG. 1 primarily.

In FIG. 1, the lowermost inboard conveyor belt 7 in the pair of belts 7 and 8 is moving to the right as indicated by the arrow marked C. Conveyor belt 7 is transporting into the machine empty bottle cases 3 which accommodate six bottles. Adjacent uppermost or outboard conveyor belt 8 is running parallel to and somewhat above belt 7 in the direction indicated by the arrow marked A and is feeding into the machine cases 4 which contain empty bottles which have been returned by customers and are presently unfit for being refilled. Conveyor belts 7 and 8 run at the same speed and in phase with each other. One of the bottle handling heads 1 is presently angulated in the left region of FIG. 1 over conveyor belt 7 and partially over conveyor belt 8. The arrow on sprocket 17 is indicative of 10 the direction in which head 1 is moving. The head referred to is presently carrying a group of six bottles 5 which are depicted in dashed lines. These bottles are filled and capped and are destined to be inserted in a case 3 on conveyor 7 when the empty case 3 and the adjacent returned bottle filled case 4 arrive at the transfer station embraced in the space between the Roman numerals II and III. Bottles 5 on head 1, which is in the process of transferring a group 5 to a conveyor belt 7 are presently being held on bottle handling heads 1 by means of the group of six grippers which were described earlier. When the head 1 arrives at the indicated transfer station II, the grippers 2 are actuated to release the bottle 5 for deposit in what was the theretofore empty case 3. The other set of six grippers on head 1 at the same time engage the returned bottles in the case 4 on conveyor belt 8 and because of the movement of the heads on the guide rods 16 as previously explained, the returned group of bottles 6 can be and are swung with a head 1 from being over conveyor belts 7 and 8 to being over conveyor belts 9 and 10 on the opposite side of the machine. On said opposite side, in the right region thereof, on conveyor belt 9 the direction of belt movement is indicated by the arrow identified by the letter D. A group of six bottles marked 5 are being conveyed to the left on conveyor belt 9. Bottles 5 are a group that are filled with a beverage, for instance, and are capped. These bottles, for instance, advance on conveyor belt 9 until they reach the bottle pick up station identified by the Roman numeral I. At this station, the grippers are actuated to grip the group of six filled and capped bottles 5. Concurrently, the other set of six grippers are controlled or actuated to release the return bottles 6 from bottle handling head 1. Return bottles 6 are deposited on conveyor belt 10 at the station adjacent where the belt is marked with the Roman numeral IV. The head 1 then moves left to the position where it is shown to the left of Roman numeral IV and begins to swing on the chain loop 15 through an arc on its way to being superimposed over belts 7 and 8. However, before the head is beginning to execute a curved path, the bottles 6 are set free and are conveyed in the direction indicated by the letter B to a site where they will be washed, inspected, filled and capped in readiness for being sent out to consumers.

When the empty returned bottles 6 are positioned on the empty bottle conveyor belt 10, the gripper elements 2 of the first group 6 are simultaneously lowered onto a group of beverage filled and crowned bottles 5 which are transported on conveyor direction D to the machine. The formation of the groups of filled bottles 5 takes place with known machinery, not shown, before the groups are deposited on conveyor belt 9. At the stations I and IV which are located beside stations II and III, the change of gripper elements takes place, whereby the gripper elements of the first group are changed from released position to the gripping position to grip the filled bottles 5 and gripper elements of the second group are substantially simultaneously changed from gripping condition to release condition to release the empty return bottles 6. Subsequently, the bottle handling head/ is slightly lifted to lift the gripper elements from the bottle mouths while the empty bottles 6 are being transported in conveyor direction B by empty bottle conveyor 10.

Since the conveyor belt pairs 7 and 8 and 9 and 10 are located next to each other, the packing machine can be kept very short and is consequently also suited for a configuration similar to the design described in German patent application DE-OS 36 20 717.

Figure 3:
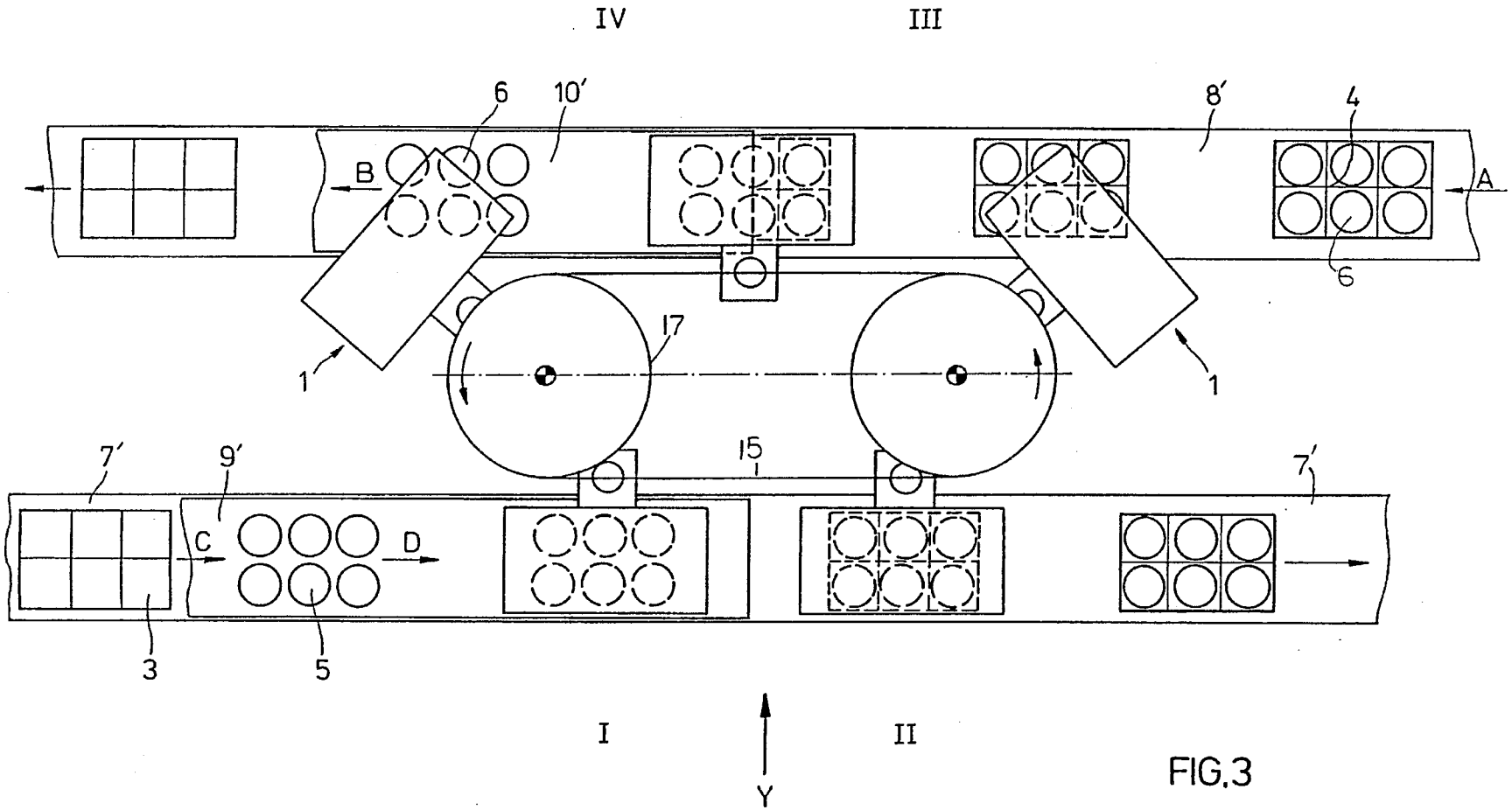
FIG. 3 is a top plan view of a second embodiment of the new packing machine concept.
Figure 4:
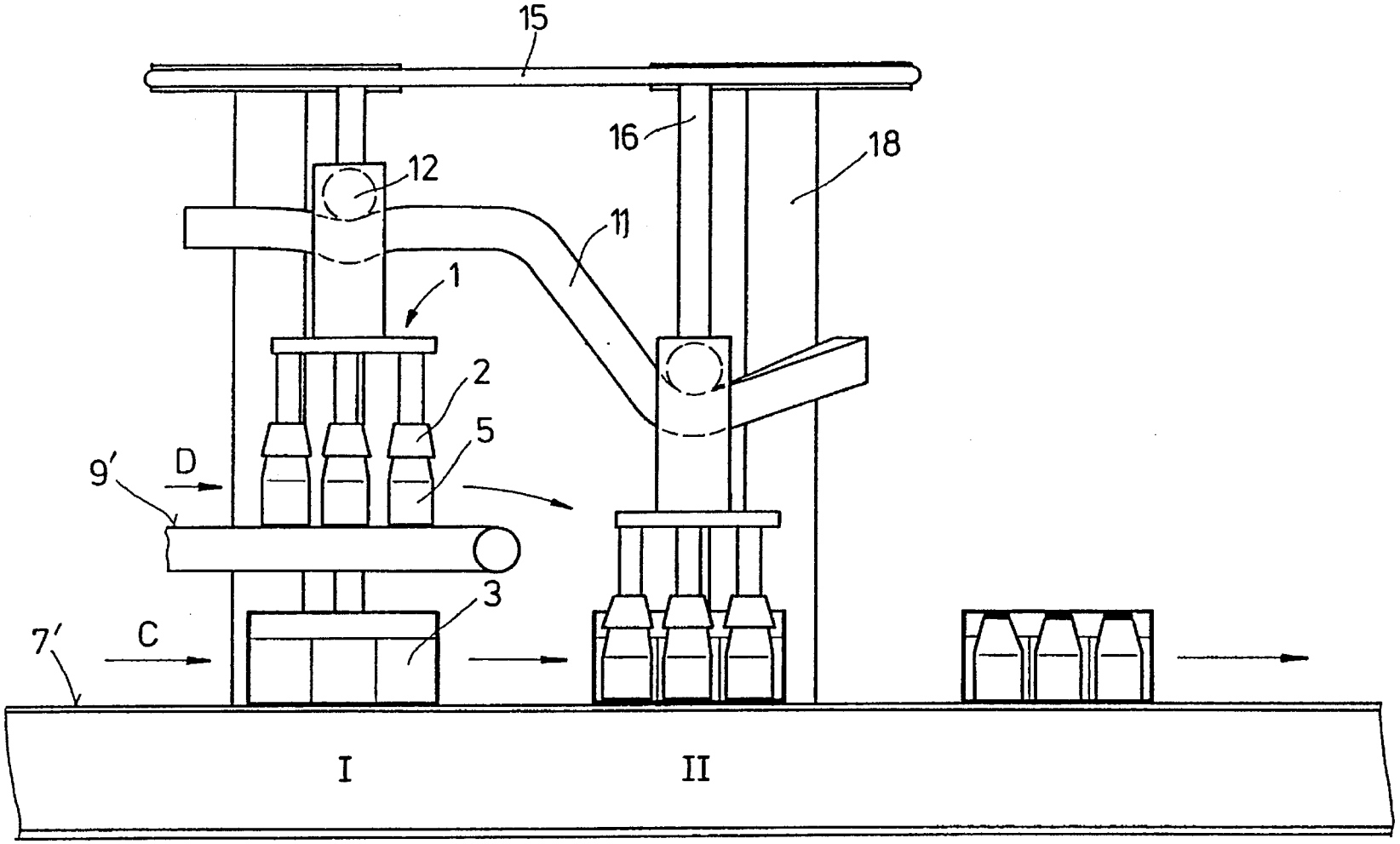
FIG. 4 is a side elevational view of the packing machine of FIG. 3 viewed in the direction of the arrow "Y" in FIG. 3.

An alternative embodiment of the dual purpose packing and unpacking machine which is similar in principle to the machine just described but has its parts differently arranged is depicted in FIGS. 3 and 4. The significant difference between the FIGS. 1 and 2 embodiment described above and the now to be discussed FIGS. 3 and 4 embodiment is in the arrangement of the case and bottle conveyor belts. In contrast with the previously described embodiment of FIGS. 1 and 2 wherein the belts are adjacent each other, in the FIGS. 3 and 4 embodiment, the belts are arranged one above the other. The conveyor belts 9 and 10 end at about the same point relative to their length in the operating station region relative to the bottle handling heads 1. Empty case 3 and 4 conveyor belts 7' and 8' are on opposite sides of the machine and are driven in opposite directions. The same is true for the bottle conveyor belts 9' and 10' where, however, the belts are driven in the same direction as the accompanying bottle case conveyor belts. The clearance height between one bottle case conveyor 7' or 8' and its accompanying bottle conveyor 9' or 10', which is positioned over it, is sufficient for a bottle to be transported under a conveyor belt.

The FIGS. 3 and 4 embodiment of the machine differs from the FIGS. 1 and 2 embodiment in that each bottle handling head 1 has only one group of six gripper elements 2 for packing as well as unpacking bottles into and out of cases, respectively, since a bottle handling head 1 executes one packing operation and one unpacking operation during a single rotation.

The following is a description of one cycle of machine operation. As shown in FIG. 3, groups of filled and capped bottles 5 are transported on conveyor 9' in direction D and in proper position while simultaneously below conveyor belt 9' empty cases 3 are advancing synchronously on case conveyor 7'. In the region of operating station I, bottle handling head i is lowered for its gripper elements 2 to engage the bottles 5 and then the gripper elements are actuated from bottle release condition to bottle gripping condition. Subsequently, bottle handling head 1 is slightly raised to lift the bottles from conveyor 9' and in a continuous operation during the forward movement relative to empty case 3 below, the bottles are released to case 3 at station II so that a case occupied by filled and capped bottles 5 can advance on conveyor belt 7' in the direction indicated by the arrow D on the belt 7' in FIG. 3. After releasing the bottles to the empty case 3 on belt 7' bottle handling head 1 is again raised by a small amount and turned 180° relative to case conveyor 8' which is running in the direction indicated by the arrow marked A. When the head 1 is aligned with belt 8' as the head is rotating from over conveyor belt 7' toward conveyor belt 8' on the opposite side of the machine, the head begins to lower to provide for its grippers to engage the empty bottles 6 in a case 4 on conveyor belt 8'. By the time the head reaches station III, empty bottles 6 in case 4 are gripped by the only one group of six gripper elements 2 on the head and the bottles are subsequently lifted out of the case by the head. Still before reaching the station IV, the head deposits the empty bottles 6 on upper conveyor belt 10' which is actually at the same elevation as conveyor belt 9' on the front side of the machine. At station 4, the gripper elements 2 are actuated to release the empty bottles 6 to upper conveyor belt 10'. Bottle handling head 1 is then immediately lifted slightly under the influence of cam 11 to free empty bottles 6 so that they can be transported away from the machine on conveyor belt 10' in the direction indicated by the arrow marked B.

The main advantage of the FIG. 3 embodiment of the machine is that it is somewhat narrower in width than the FIGS. 1 and 2 embodiment so the FIG. 3 embodiment occupies less floor space in the plant. The FIG. 3 embodiment also offers good accessibility to the bottles and cases by service personnel in the region of the rotational heads 1. Also, note that the heads 1 are not carrying any bottles as they swing laterally across the machine between conveyor 8', 10' and 7, '9'.

I claim:

1. A machine for removing a group of articles of a first type, including empty bottles, from containers including cases moving on a conveyor; to insert articles of a second type including filled bottles, into containers including cases moving on another conveyor, said machine comprising:

laterally spaced apart pairs of longitudinally extending linear conveyors, the conveyors in a pair translating parallel to each other and the spaced apart pairs translating parallel to each other, longitudinally spaced apart wheels arranged in the space between said pairs of the conveyors and mounted for rotating about vertical axes, a closed loop flexible element running in a horizontal plane on said wheels to define an oblong path of translation for said flexible element, and drive means for driving at least one of the wheels rotationally, a plurality of heads supported at equally spaced apart positions on said closed loop flexible element, each head having at least one group of grippers controllable to grip and pick up and release a group of articles from and to one of said conveyors, respectively, said heads moving in the oblong path defined by said closed loop flexible element to pass back and forth across the space between the conveyor pairs and alternately over the laterally spaced apart pairs of conveyors, said grippers on said heads controlled to grip and withdraw groups of articles of the first type from containers on one of the conveyors for the heads to transport the groups along said oblong path to be released to another of the conveyors, and said grippers on said heads controlled to grip groups of articles of the second type on one of the conveyors for the heads to transport the groups along said oblong path to be released for being inserted in a container on another of the conveyors, and the containers from which the articles of the first type are withdrawn remain on the same conveyor for being conveyed away from said machine and the containers into which the articles of a second type are inserted remain on the same conveyor for being conveyed away from said machine.

2. A machine for removing articles of a first type, including empty bottles, from containers, including bottle cases moving on a conveyor and for depositing articles of a second type, including filled bottles, into containers including bottle cases, said machine comprising:

first and second pairs of longitudinally extending conveyors laterally spaced apart from each other, all of said conveyors translating parallel to each other, longitudinally spaced apart wheels arranged between said first and second pairs of conveyors for rotating about vertical axes and a closed loop flexible element running in a horizontal plane on said wheels to define an oblong path of translation for said closed loop flexible element and means for driving at least one of the wheels rotationally, a plurality of article handling heads supported at equally spaced apart positions on said closed loop flexible element and moving in the oblong path defined by the flexible element, each head having at least one group of article grippers mounted thereon and the heads are controllable to alternatively grip and pick up and release groups of articles being conveyed, one of the conveyors of said first pair being for conveying empty containers incoming to the machine to a position of access by one of said heads translating on said closed loop flexible element and the other conveyor of said first pair being for conveying containers containing a group of articles of the first type incoming to the machine in phase with said empty containers to a position of access by said one head, one of the conveyors of the second pair being for conveying incoming to the machine groups of articles of the second type to a position of one of said heads and the other conveyor of the second pair being for conveying articles of the first type outgoing from the machine, the heads operating in a continuous sequence wherein the grippers on a translating head are controlled to grip a group of incoming articles of the second type on one conveyor of the second pair of conveyors and carry the group to over an empty container on the one of the conveyors of the first pair of conveyors where the grippers are controlled to release and deposit the group of containers of the second type in said empty container while other said grippers on the head are controlled to concurrently grip and withdraw a group of articles of the first type from a container on said other conveyor of the first pair and carry the group to over said other conveyor of the second pair where the grippers are controlled to release the articles for conveying away from the machine on said other conveyor of the second pair while the empty containers from which the articles were withdrawn are conveyed away from the machine on said other conveyor of the first pair.

3. The machine according to claim 2 wherein said wheels are sprockets and said closed loop flexible element is a chain.

4. The machine according to claim 2 wherein said One conveyor of said first pair is immediately adjacent the space between said first and second pairs of conveyors and translates at an elevation lower than the other conveyor in said first pair which is more remote from said space, and said one conveyor of the second pair is immediately adjacent said space and translates at a lower elevation than said other conveyor in said second pair which is more remote from said space, and both conveyors in said second pair translate at a higher elevation than the conveyors of said first pair.

5. The machine according to claim 2 wherein said one conveyor of the second pair for incoming articles of the second type runs at a lower elevation than the other conveyor of the second pair for outgoing articles of the first type.

6. The machine according to claim 2 wherein said one conveyor of the second pair for incoming articles of the second type and said other conveyor of the second pair for outgoing articles of the first type partially overlap each other in the longitudinal direction.

7. The machine according to claim 5 wherein said conveyors in said second pair run in the same direction and said conveyors of the first pair run in the same direction but in an opposite direction from said conveyors in the second pair.

8. The machine according to claim 6 wherein said conveyors in said second pair run in the same direction and said conveyors of said first pair run in the same direction but in an opposite direction from said conveyors in said second pair.

9. The machine according to any one of claims 2, 3, 4, 5, 6, 7 or 8 wherein said heads have two said groups of controllable grippers mounted thereon, one said gripper group positioned for gripping and carrying a group of incoming articles of the second type on said one conveyor of said second pair of conveyors to release and deposit the group of articles of said second type in an empty container on said one conveyor of the first pair and the other said gripper group being positioned to lift articles of the first type from a container on said other conveyor of the first pair for carrying the articles of the first type for release and deposit on said other conveyor of the second pair such that said carried articles of the first type may be conveyed away from the machine.

10. The machine according to any one of claims 1 or 2 including cams positioned, respectively, adjacent each of the pairs of conveyors and each head has a cam follower cooperating with a respective one of said cams to raise said head for the grippers to pick up a group of articles and to lower the head to provide for the grippers releasing the articles.

* * * * *